US012305347B1

(12) United States Patent
Way

(10) Patent No.: US 12,305,347 B1
(45) Date of Patent: May 20, 2025

(54) MARINE RAIL LIFT SYSTEM

(71) Applicant: Robert Lindsay Way, Brunswick, GA (US)

(72) Inventor: Robert Lindsay Way, Brunswick, GA (US)

( * ) Notice: Subject to any disclaimer, the term of this patent is extended or adjusted under 35 U.S.C. 154(b) by 103 days.

(21) Appl. No.: 18/213,033

(22) Filed: Jun. 22, 2023

Related U.S. Application Data

(60) Provisional application No. 63/354,569, filed on Jun. 22, 2022.

(51) Int. Cl.
*E02C 5/02* (2006.01)
*B63C 3/06* (2006.01)

(52) U.S. Cl.
CPC . *E02C 5/02* (2013.01); *B63C 3/06* (2013.01)

(58) Field of Classification Search
CPC ..... E02C 5/02; B63C 3/06
USPC ..... 405/3
See application file for complete search history.

(56) References Cited

U.S. PATENT DOCUMENTS 3,276,211 A * 10/1966 Drake ..... B63C 1/02 114/45
3,857,248 A * 12/1974 Rutter ..... B63C 3/06 114/45
4,641,595 A * 2/1987 Pritchett ..... B63C 3/06 405/3
4,934,298 A * 6/1990 Pritchett ..... B63C 3/06 114/45
4,976,211 A * 12/1990 Reinhardt ..... B63C 3/06 405/3
5,016,551 A * 5/1991 Peck ..... B63C 1/02 114/45
5,549,070 A * 8/1996 Cruchelow ..... B63C 3/06 114/263
5,860,765 A * 1/1999 Cruchelow ..... B63C 1/02 114/263
8,267,621 B1 * 9/2012 Way ..... B63C 3/06 114/44
9,132,897 B2 * 9/2015 Barnes ..... B63B 43/04
10,370,073 B2 * 8/2019 Barnes ..... B63C 1/06
11,027,801 B2 * 6/2021 Barnes ..... B63C 1/06
2016/0016648 A1 * 1/2016 Siokos ..... B66F 7/0641 114/45

* cited by examiner

*Primary Examiner* — Frederick L Lagman
(74) *Attorney, Agent, or Firm* — Richard Eldredge; Leavitt Eldredge Law Firm

(57) ABSTRACT

A marine rail lift has a lift deck assembly configured to receive a watercraft thereupon and move between a raised position and a lowered position relative to a parent dock. A plurality of track rails connected to the side walls of a berth of the parent dock define a movement path of the lift deck assembly between the raised position and the lowered position. A plurality of retractable track pins engage the lift deck assembly to the track rails. A lift control system is operatively engaged with the lift deck assembly and configured to displace the lift deck assembly between the raised position and the lowered position. The lift control system manages the volume of air contained within one or more lift tanks of the lift deck assembly to control displacement of the lift deck assembly through buoyant force.

11 Claims, 15 Drawing Sheets

RAISED POSITION

PARKED POSITION

MARINE RAIL LIFT SYSTEM

BACKGROUND

1. Field of the Invention

The present invention relates generally to marine vessel lifting systems, and more specifically to a seamlessly integrated marine rail lift system capable of transitioning watercraft between a parked position and a lowered position relative to a parent dock.

2. Description of Related Art

Marine lifting systems are recognized in the art as effective solutions for elevating watercraft out of water for purposes such as maintenance, repair, or storage. Traditional marine rail lift systems employ an array of ballast tanks positioned within a structural frame to raise the watercraft by filling and emptying the tanks with air. Moreover, marine rail lift systems are typically separate entities from their parent docks, necessitating sturdy physical connections to the dock's structure.

A key issue associated with current marine lifting systems lies in their overall design. Existing marine rail lift systems fail to offer an integrated solution within the parent dock, thereby disrupting the parent dock's aesthetic continuity. Furthermore, these systems are limited to elevating only watercraft, compelling users to seek alternative methods for raising and lowering other types of loads into and out of the water.

Therefore, there is a clear advantage to a system that seamlessly integrates into the parent dock, contributing to an aesthetically consistent appearance for the parent dock. Additionally, a system capable of raising and lowering a variety of load types into and out of water while providing additional functional deck surface area would be highly beneficial.

Accordingly, although great strides have been made in the area of marine lifting systems, many shortcomings remain. It is therefore an objective of the present invention to provide a rail track floating dock lift system that addresses these issues by offering a seamless integration with the parent dock, adaptability to various marine environments, and a mechanism to maintain the elevator deck parallel with the parent dock regardless of load imbalance.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
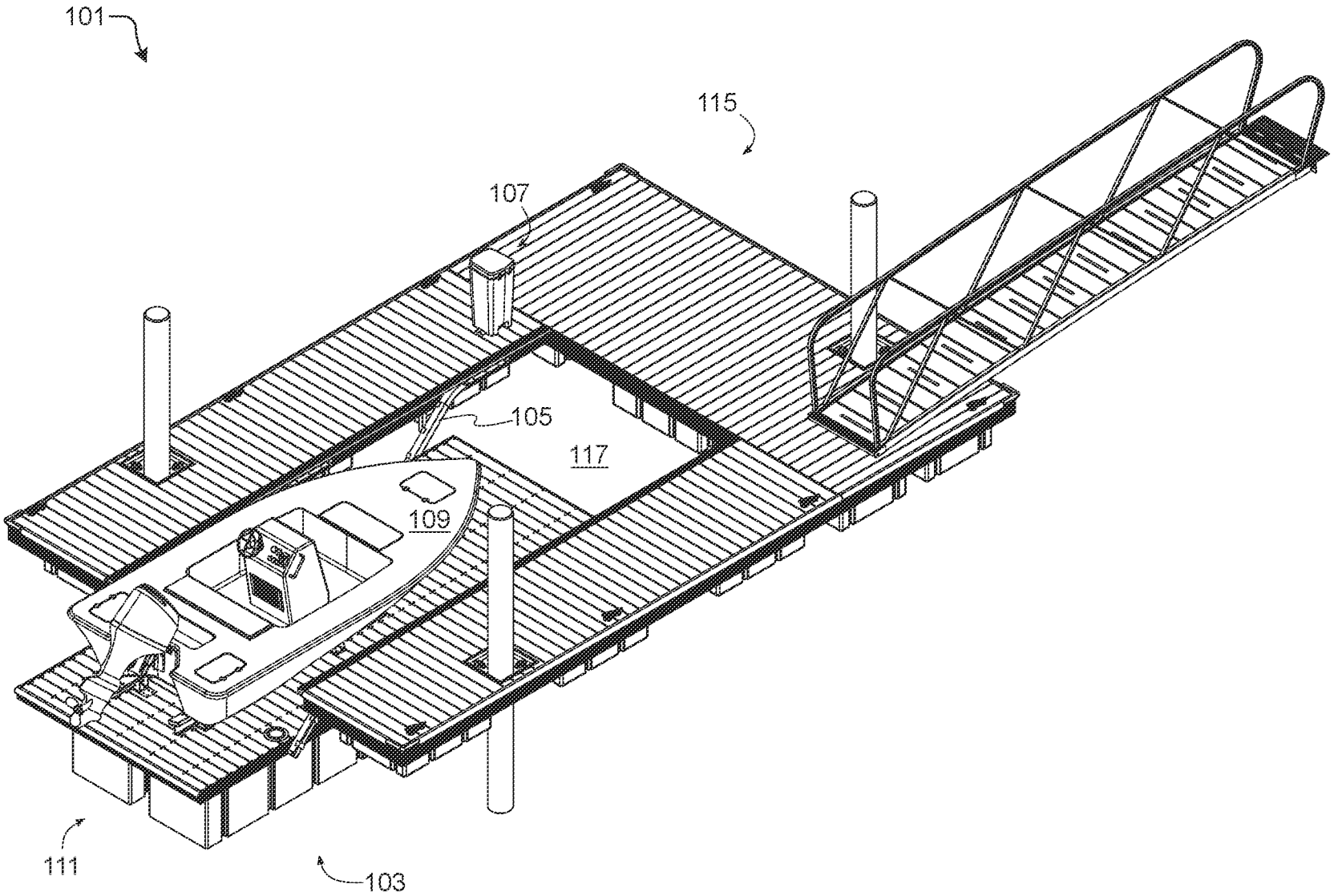
FIG. 1 is an isometric view of a preferred embodiment of the marine rail lift system of the present application configured for a v-hull watercraft with the lift deck assembly in the lowered position.
Figure 2:
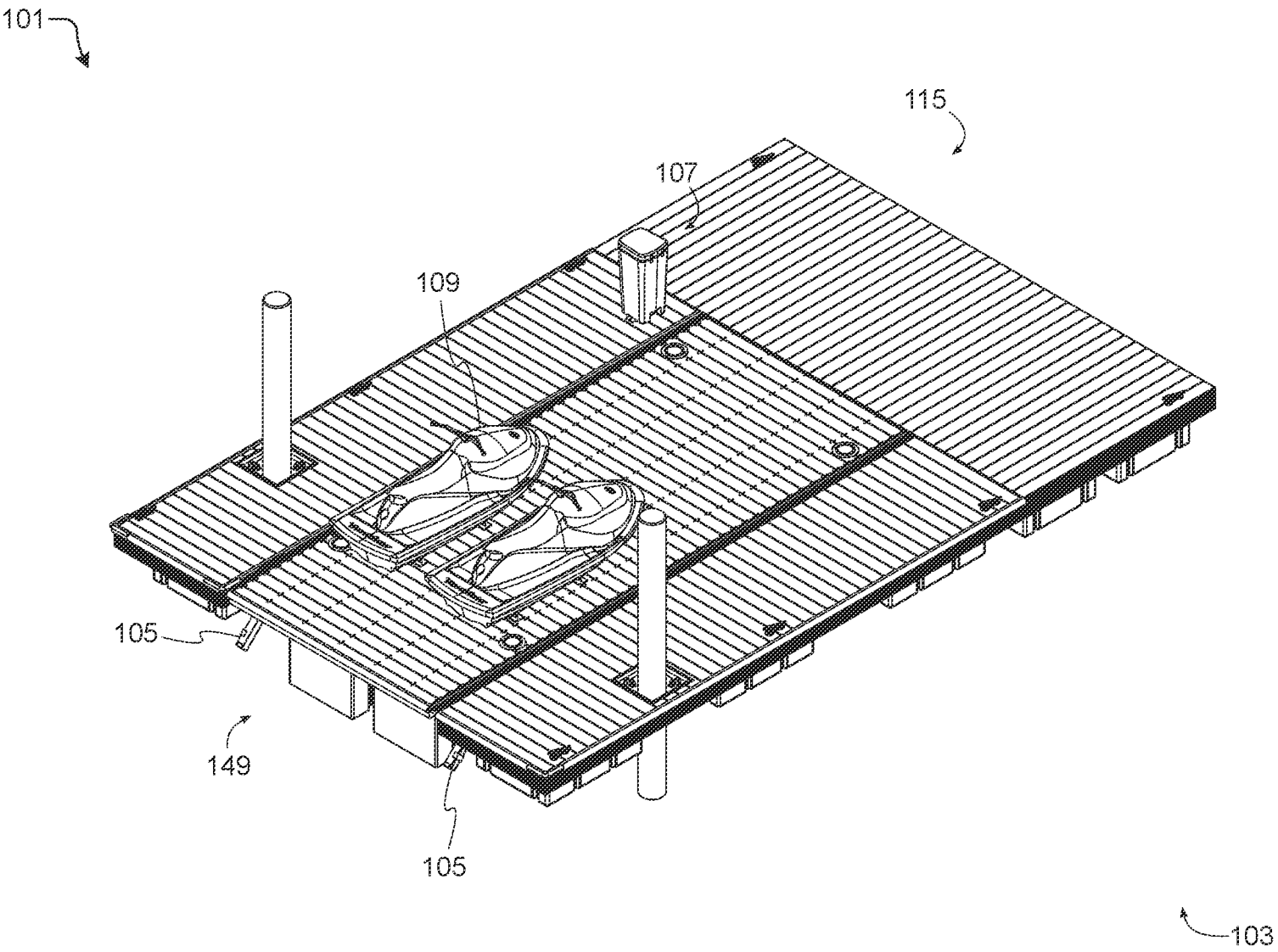
FIG. 2 is an isometric view of a preferred embodiment of the marine rail lift system of the present application configured for a pair of personal watercraft with the lift deck assembly in the lowered position.
Figure 3:
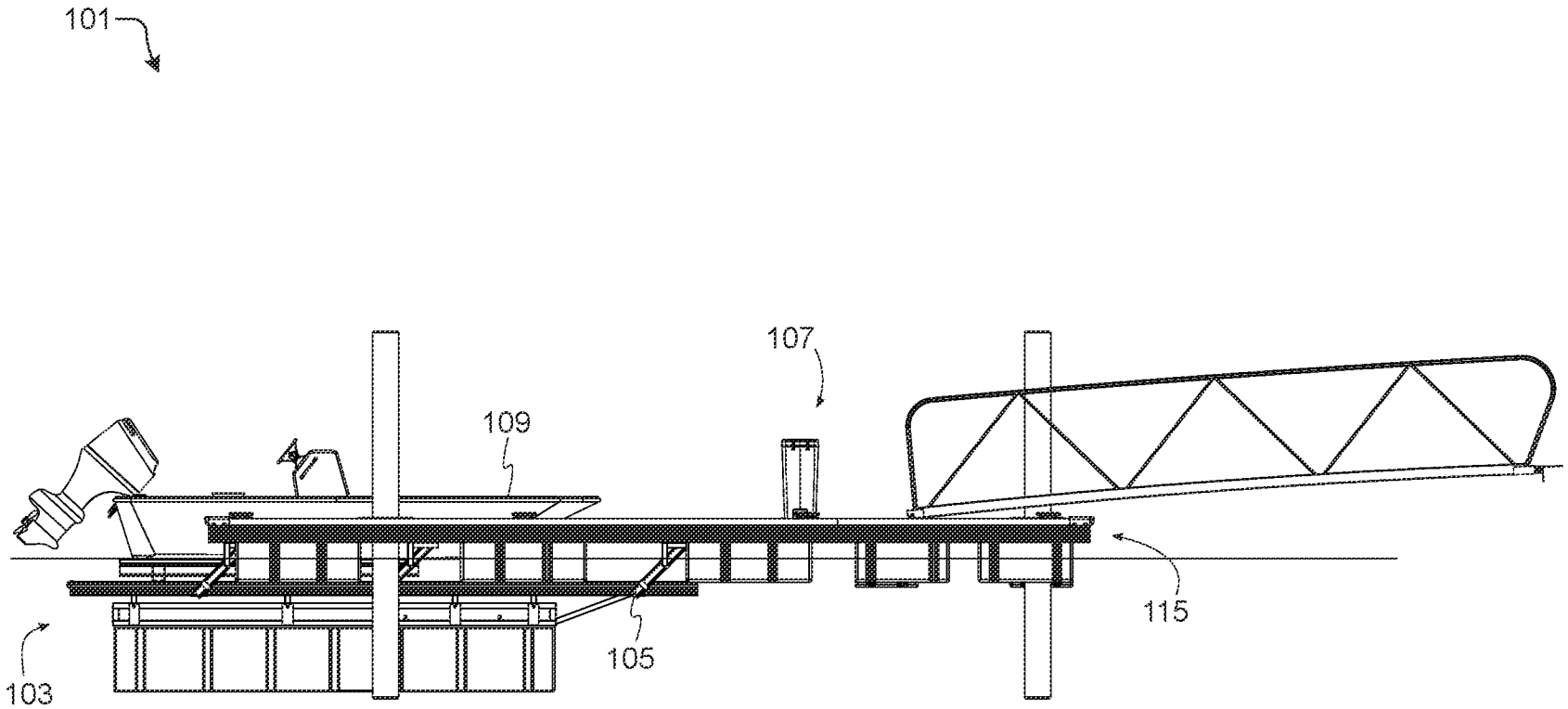
FIG. 3 is an elevation view of FIG. 1.
Figure 4A:
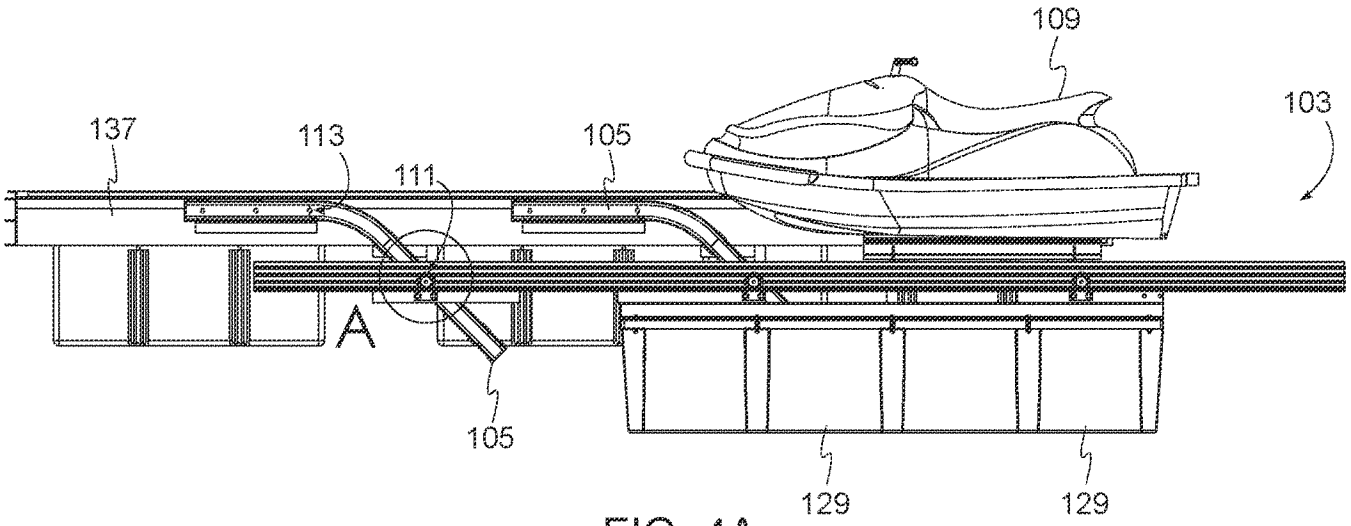
FIG. 4A is an elevation view showing a single finger dock and a personal watercraft.
Figure 4B:
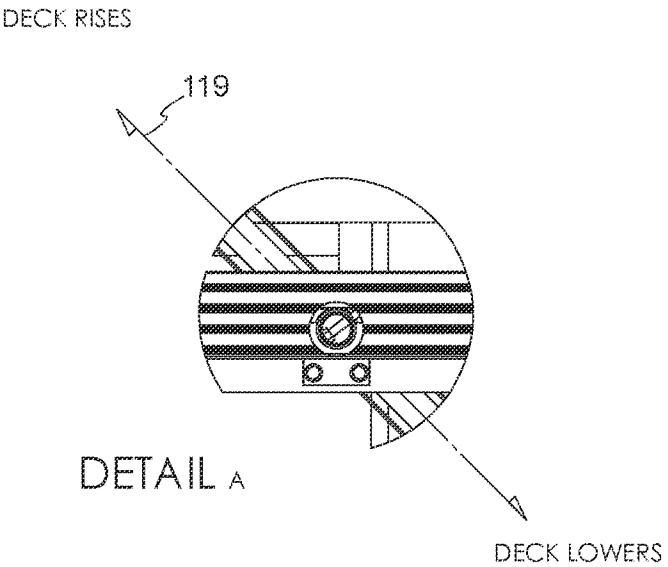
FIG. 4B is an elevation detail view of the movement path of a track pin in a track rail.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional marine lift systems. Specifically, the system of the present invention provides a marine rail lift system that seamlessly integrates with the parent dock and ensures secure and balanced lifting and lowering of watercraft between dock level and water level. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 1-4 depict several views of a marine rail lift system 101 in accordance with a preferred embodiment of the present application. It will be appreciated that marine rail lift system 101 overcomes one or more of the above-listed problems commonly associated with conventional watercraft hoisting and launching apparatuses. In addition, it should be appreciated that more or fewer of such components may be included in different embodiments of the marine rail lift system. The lift system of the present invention may be retro-fitted into existing floating docks or can be designed and manufactured as a complete lift and parent dock system.

In the contemplated embodiment, system generally 101 includes a lift deck assembly 103, a plurality of track rails 105, and a lift control system 107, as shown in FIGS. 1-4. The lift deck assembly 103 is configured to accept one or more watercraft 109 thereupon and further configured to move between a lowered position 111 and a raised position 113 relative to a parent dock 115 along the plurality of track rails 105. The track rails 105 are connected within a berth 117 of the parent dock 115 and define a movement path 119 of the lift deck assembly 103 between the lowered position 111 and the raised position 113, as illustrated in FIGS. 4A and 4B.

The lift control system 107 provides means for a user or operator of the present invention to raise and lower the lift deck assembly 103 on command. The lift control system 107 is operatively engaged with the lift deck assembly 103 and configured to regulate displacement of the lift deck assembly 103 between the lowered position 111 and the raised position 113. In the contemplated embodiment, the lift control system 107 manipulates the volume of air within one or more ballast lift tanks 129 of the lift deck assembly 103 in order to sink or float the lift deck assembly 103 and thereby displace it along the track rails 105, which function to constrain the movement of the lift deck assembly 103 between the lowered position 111 and the raised position 113. As such, the lift deck assembly 103 is configured, in conjunction with the lift control system 107, to displace a watercraft 109 disposed atop the lift deck assembly 103 between the lowered position 111 and the raised position 113.

The present invention provides an automatic and user-friendly process for transitioning one or more watercraft 109 such as jet skis, v-hull boats, or other personal watercraft or types of boats between dry land and water. Moreover, when the lift deck assembly 103 is in the raised position 113 without bearing the weight of a watercraft or other load, a seamless and usable expanded deck surface is formed in combination with the parent dock 115, in contrast to existing boat lift designs which leave an unusable and unsightly void in the dock.

It is further contemplated and will be appreciated that though the primary intent of the present invention is to focus on lifting and lowering watercraft 109 into and out of the water, the present invention is adaptable to various different live loads and utilitarian uses; as long as the deck load capacity is not exceeded, the lift deck assembly 103 can be used to lift and lower any live load placed thereupon.

Figure 5:
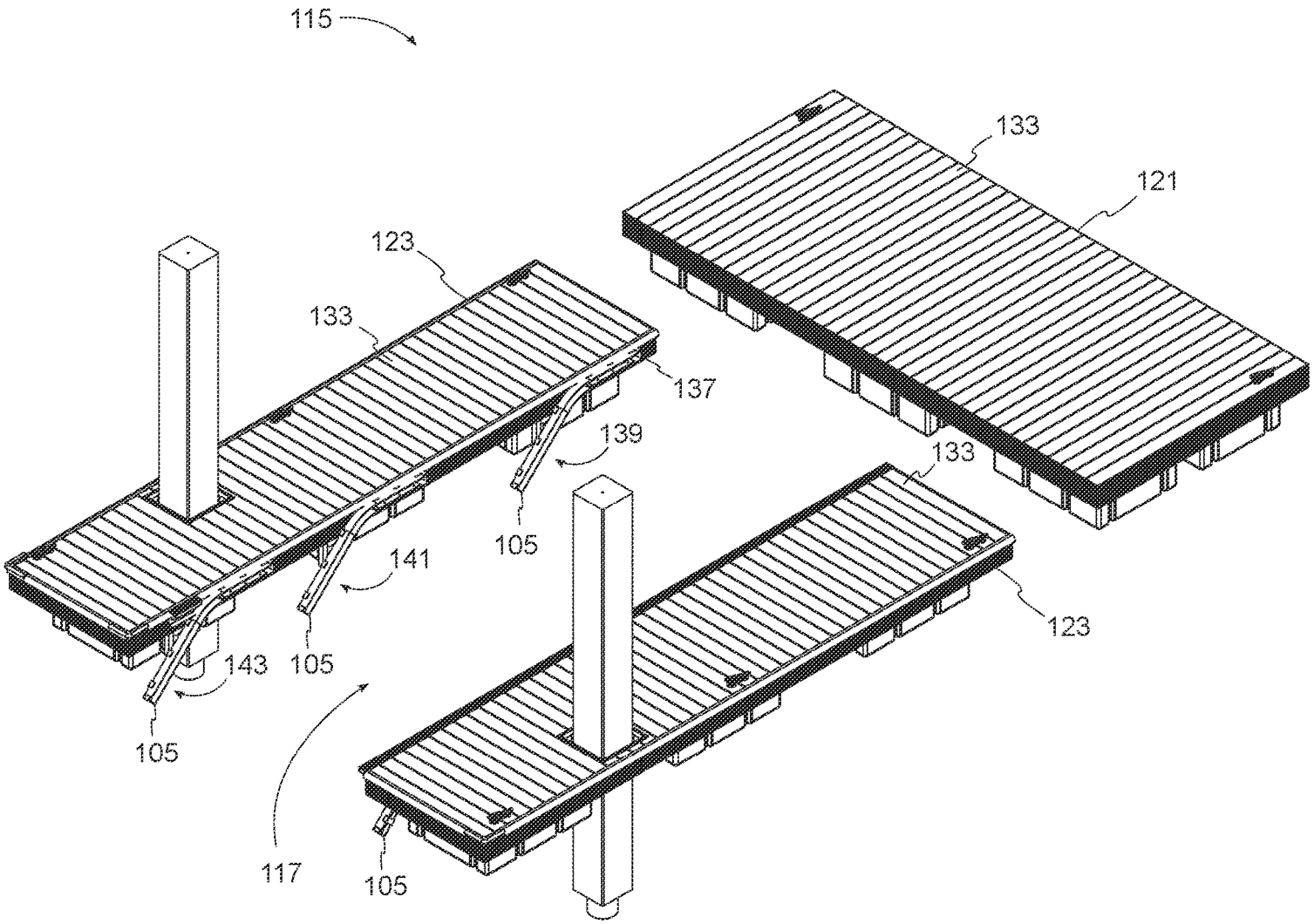
FIG. 5 is an isometric exploded view of a parent dock with a header dock portion and a pair of finger dock portions.

As seen in FIG. 5, the parent dock 115 preferably includes a header dock portion 121 and a pair of finger dock portions 123 affixed to the header dock portion 121 through any suitable means, such as being bolted together. The finger dock portions 123 are positioned opposite each other across the berth 117, forming a horseshoe dock configuration around the berth 117. Each track rail 105 is connected to one of the finger dock portions 123 delineating the berth 117. In some embodiments, the parent dock 115 may utilize polypropylene foam core polyethylene floats. Though it is not considered of any particular importance what type of float is used for the parent dock 115, the currently most popular residential floating docks are framed in aluminum or wood, as the parent dock 115 of the present invention may be, or another suitable material. Concrete docks are generally reserved for commercial docks.

Aluminum floating docks will almost always utilize Roto-Molded floats which are polyethylene shells (hollow, rectangular shapes) filled with polystyrene foam. The shells are generally thin walled (0.15"-0.18"). The injected foam interior is used to prevent the float side walls from distorting or collapsing under pressure but also to prevent water from filling the float should a puncture occur in the outer plastic shell.

Figure 6:
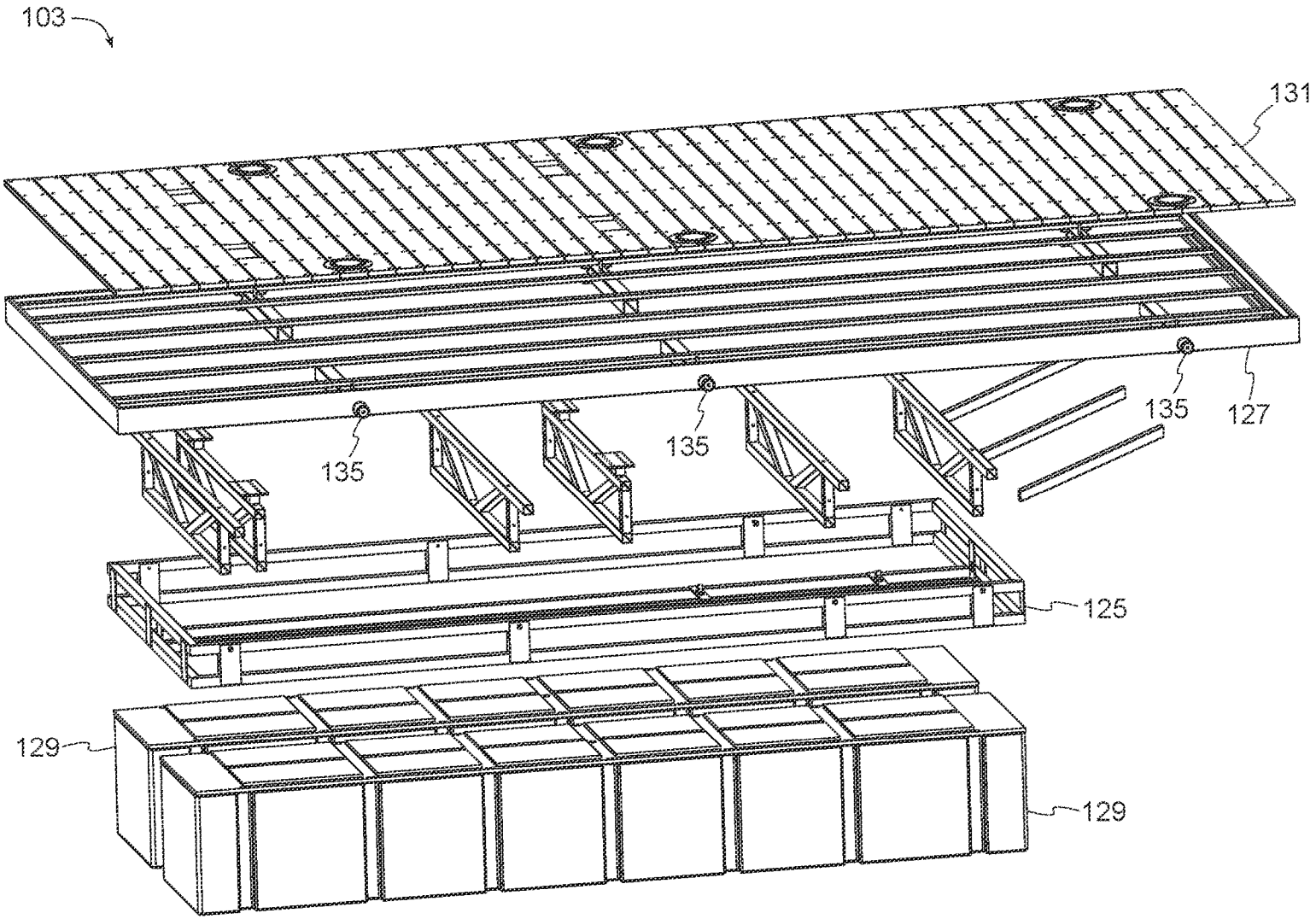
FIG. 6 is an isometric exploded view of the lift deck assembly.

In the contemplated embodiment, referring to FIG. 6, the lift deck assembly 103 comprises a float frame 125, a deck support frame 127, one or more lift tanks 129, and a lift decking 131. The lift decking 131 is connected atop the deck support frame 127, and the lift tanks 129 are constrained within the float frame 125 beneath the lift decking 131. Preferably, the lift tanks 129 are hollow core lift tanks, manufactured from plastic or another suitable material, and any suitable means to connect the lift tanks 129 to the float frame 125 may be incorporated.

The float frame 125 and the deck support frame 127 are affixed together, through welding, fasteners such as bolts, or another means. The float frame 125 and the deck support frame 127 are highly rigid and ensure that loads applied to the lift decking 131 are transferred and distributed equally to the lift tanks 129. The lift tanks 129 provide lift to the lift deck assembly 103. Any dead load and/or live load placed upon the lift deck assembly 103 is borne by the buoyancy of the lift tanks 129. The lift tanks 129 must be hollow because by their nature, varying degrees of buoyancy are required to operate the lift deck assembly 103. The lift tanks 129 do not contain foam (to prevent side wall crushing under loads) and therefore will generally have much thicker walls than that found in static floats, typically between 0.35" and 0.42" thick. The lift deck assembly 103 may incorporate hollow core, thick-walled polyethylene floats as the lift tanks 129, or any other suitable material and float configuration in various embodiment.

The track rails 105 are connected in pairs to opposing side walls 137 of the berth 117. More particularly, the plurality of track rails 105 comprises a plurality of pairs of track rails evenly distributed along the side walls 137 of the berth 117. In the contemplated embodiment, the plurality of track rails 105 comprises three pairs of track rails in three positions—forward 139, midship 141, and aft 143, as seen in FIG. 5—along the length of the berth 117, in order to evenly distribute load. In other embodiments, more than three pairs of track rails may be included.

Figure 7:
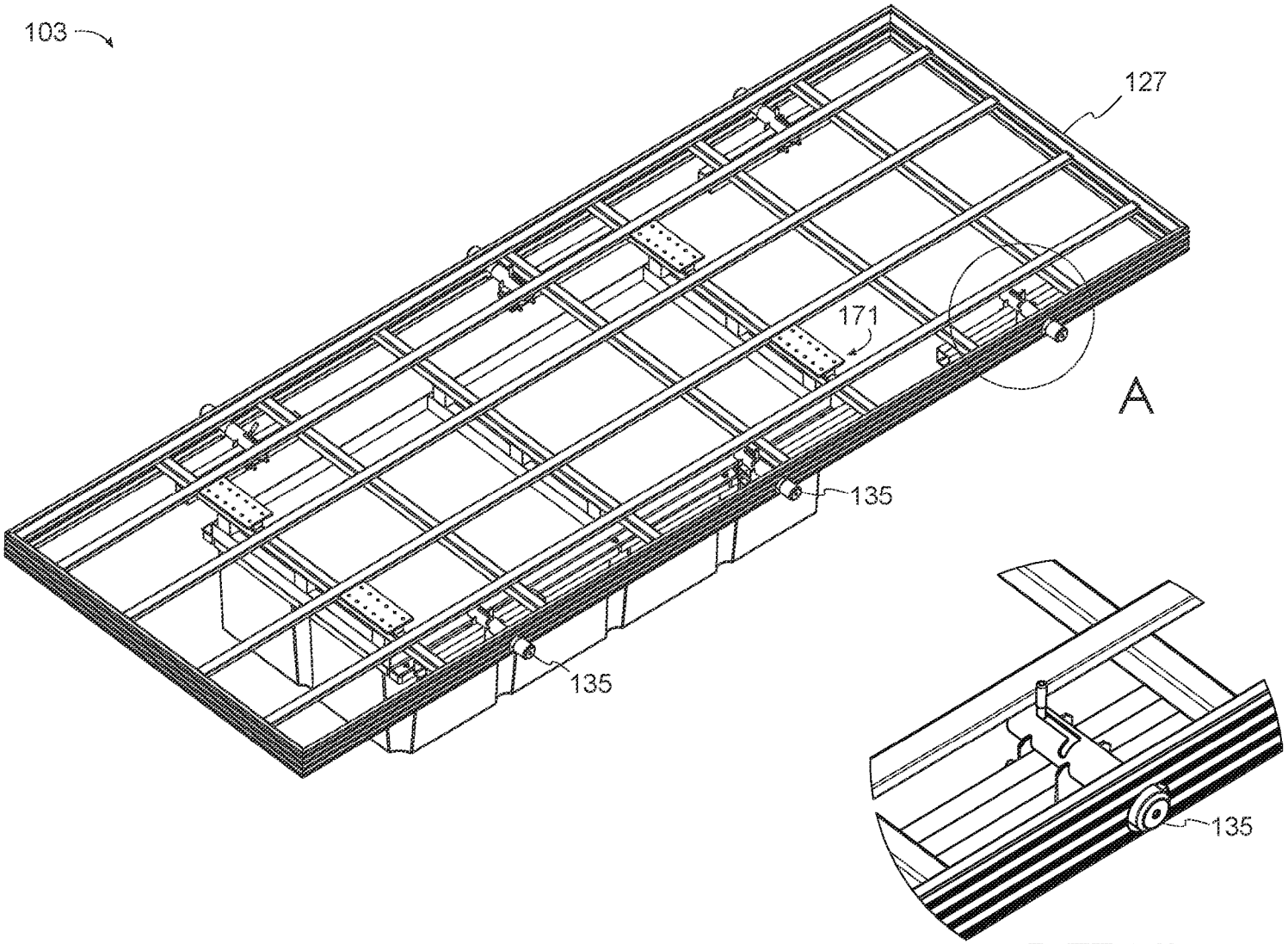
FIG. 7 is an isometric view of the lift deck assembly with the lift decking removed for clarity and a detail view of a retractable track pin.
Figure 8:
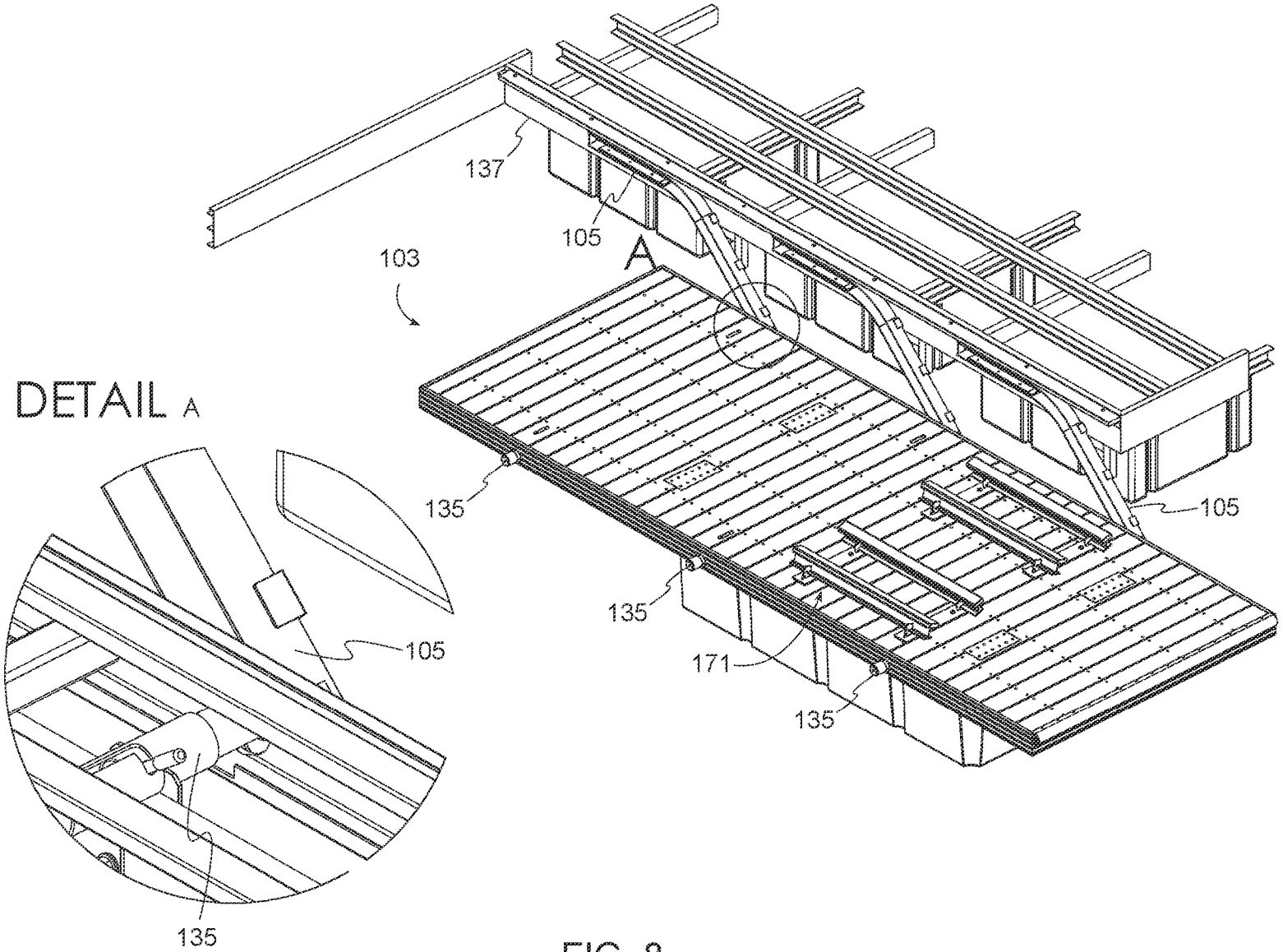
FIG. 8 is an isometric view of a simplified parent starboard side finger dock with rails attached and the lift deck assembly in the lowered position.

Referring to FIGS. 7-9, in the contemplated embodiment, the lift deck assembly 103 is further equipped with a plurality of retractable track pins 135. The track rails 105 are used to guide the movement of the lift deck assembly 103 by providing a slot for the track pins 135 to be constrained within and follow. The retractable track pins 135 are captured within and protrude laterally from the sides of the lift deck assembly 103, and are configured to securely lock into the track rails 105 in order to ensure stability and alignment of the lift deck assembly 103 throughout its movement path 119 between the lowered position 111 and the raised position 113 regardless of load. The track rails 105 and retractable track pins 135 are not intended to bear any substantial load and simply act as a guide constraining the motion of the lift deck assembly 103.

Figure 9C:
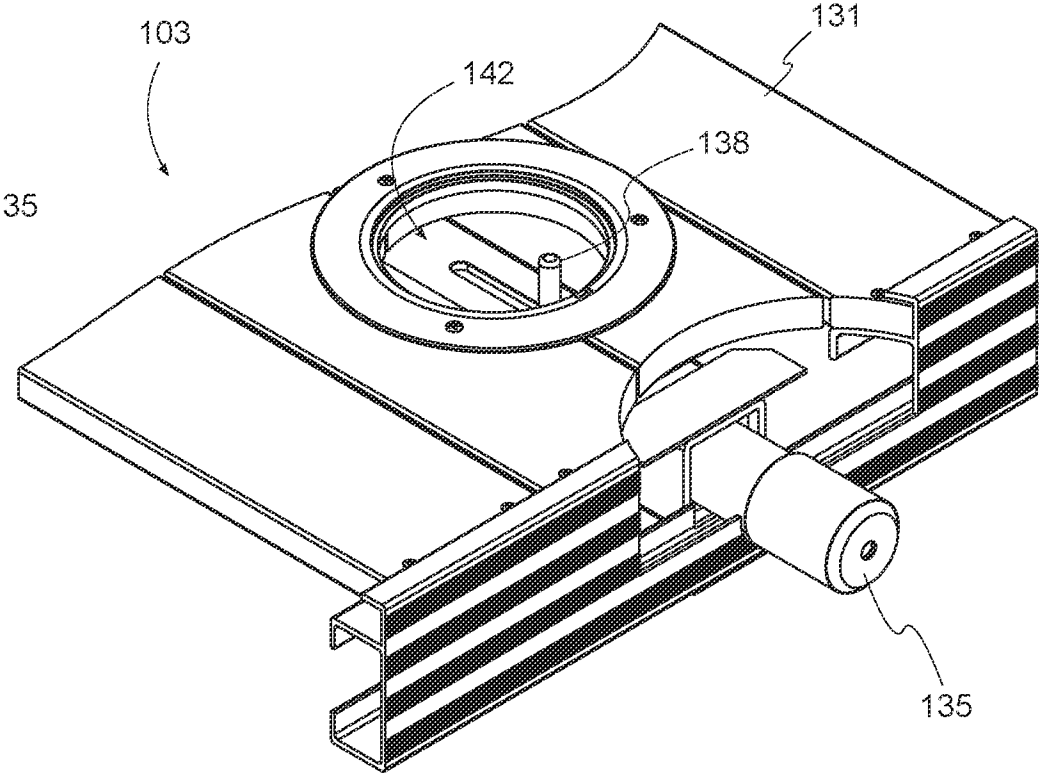
FIG. 9C is an isometric view with cut-away showing a track pin installed in the lift deck assembly with an access aperture.
Figure 9A:
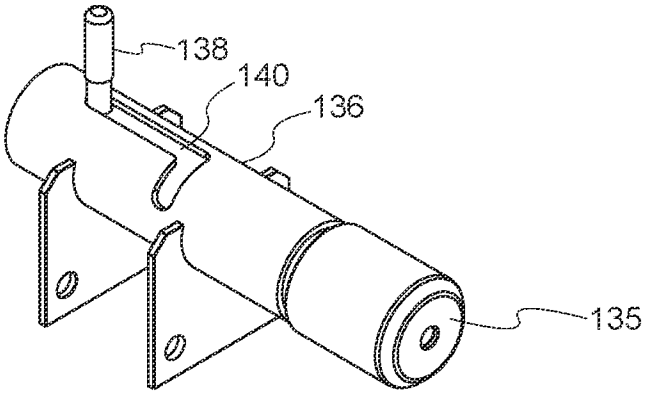
FIG. 9A is an isometric view of a retractable track pin, pin housing, and actuator handle assembly in a retracted state.
Figure 9B:
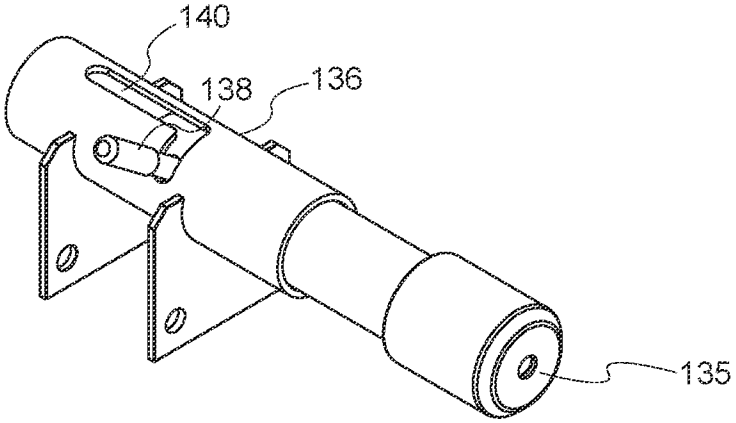
FIG. 9B is an isometric view of in an extended state.
Figure 10D:
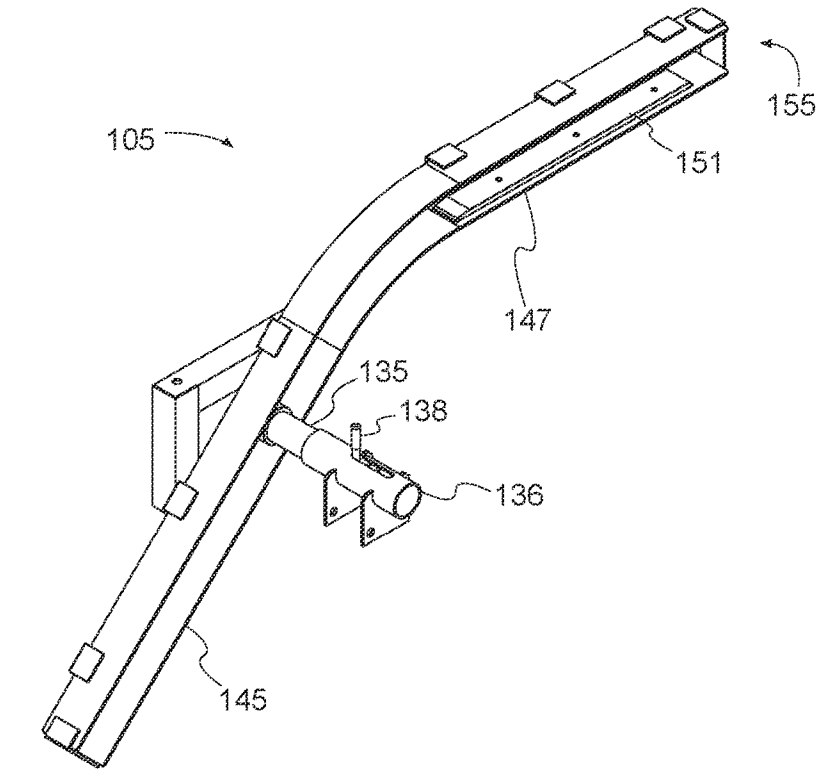
FIG. 10D is an isometric view of a track rail including a track pin between the lowered position and the raised position.
Figure 10A:
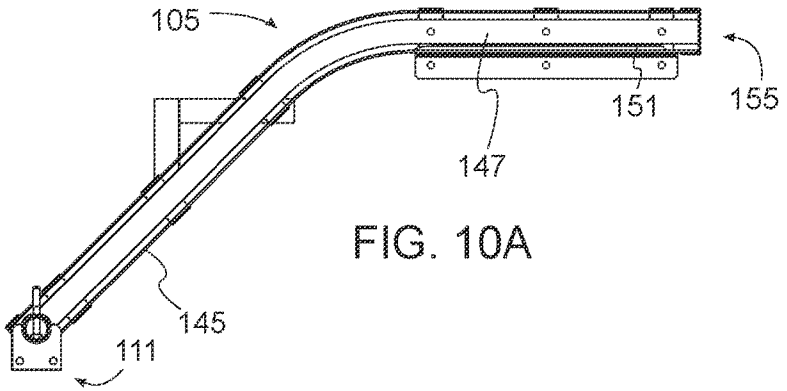
FIG. 10A is an elevation view of a track rail including a track pin at the lowered position.
Figure 10B:
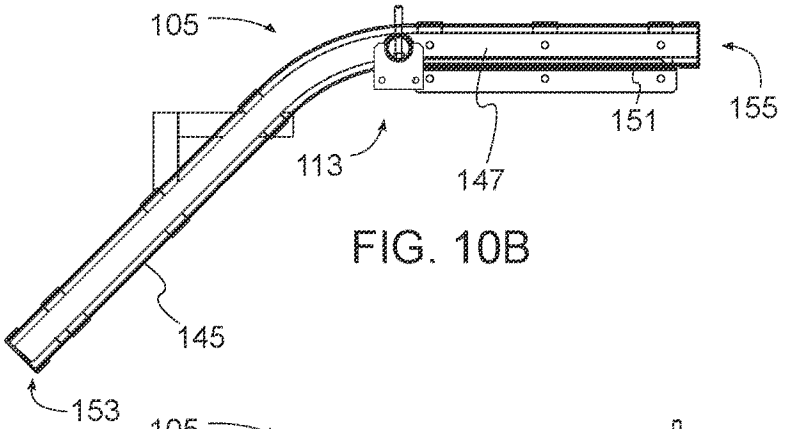
FIG. 10B is an elevation view of a track rail including a track pin at the raised position.
Figure 10C:
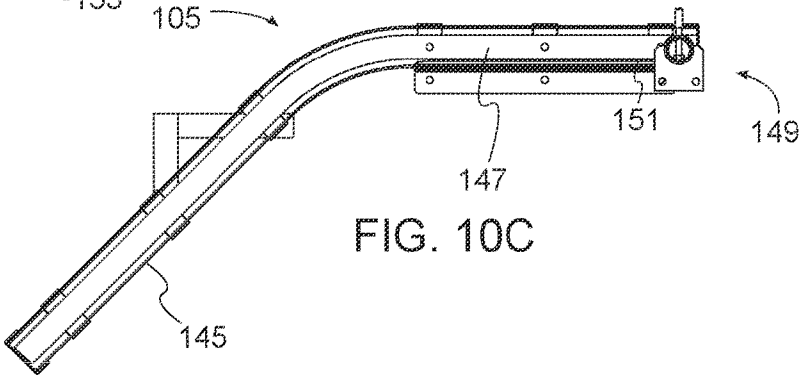
FIG. 10C is an elevation view of a track rail including a track pin at the parked position.

It is contemplated that the track pins 135 may be retractable through any suitable mechanical means. In the contemplated embodiment, the track pins 135 may be releasably engaged into an extended position through a bayonet lock, as shown in FIGS. 9A-9C. The track pin 135 is held within a pin housing 136, with an actuator handle 138 laterally protruding from the track pin 135 through an L-shaped aperture 140 in the housing. To extend the track pin 135, the user moves the actuator handle along the main arm of the L, and then rotates the handle along the base of the L, locking the track pin in the extended position. For each track pin, 135, a pin access aperture 142 traversing through the lift decking 131 may be included, providing the user access to the actuator handle 138 for manual manipulation of the track pin 135.

Referring to FIGS. 10A-10D, each of the plurality of track rails 105 comprises an angled lift portion 145 and a horizontal parking portion 147. The horizontal parking portion 147 is connected to the side walls 137 of the berth 117. The angled lift portion 145 extends at a downward angle from the horizontal parking portion 147, guiding the descent or ascent of the lift deck assembly 103 into or out of the water. The track rails 105 extend between a first end 153 on the angled lift portion 145 and a second end 155 on the horizontal parking portion 147. The lift control system 107 is configured to displace the lift deck assembly 103 between the lowered position 111 and the raised position 113 along the angled lift portion 145 of the track rails 105.

Figure 11:
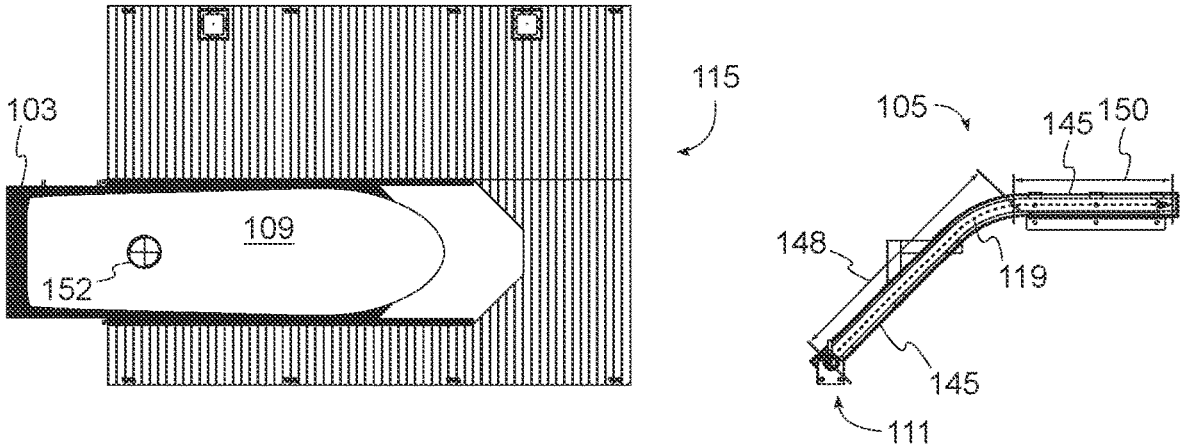
FIG. 11 is a series of plan views of the system paired with corresponding elevation views of a track rail showing a movement progression of the lift deck assembly from the lowered position to the raised position and the parked position.
Figure 11:
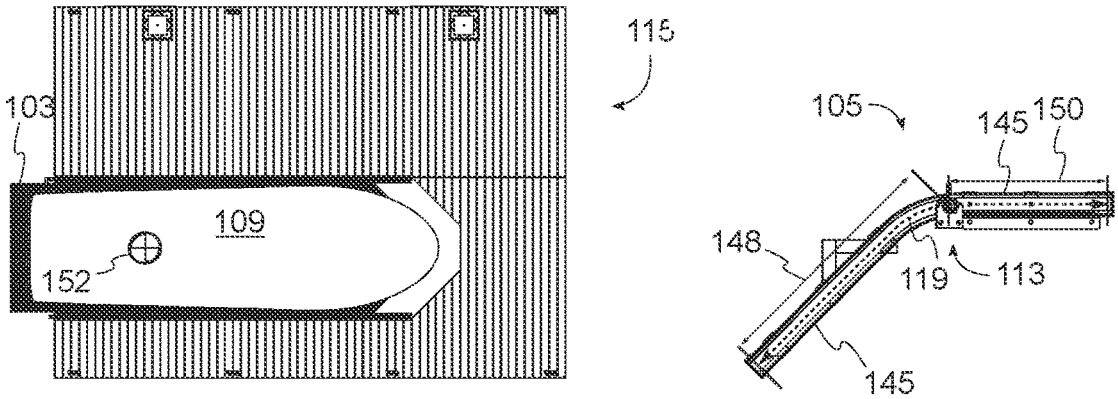
Figure 11:
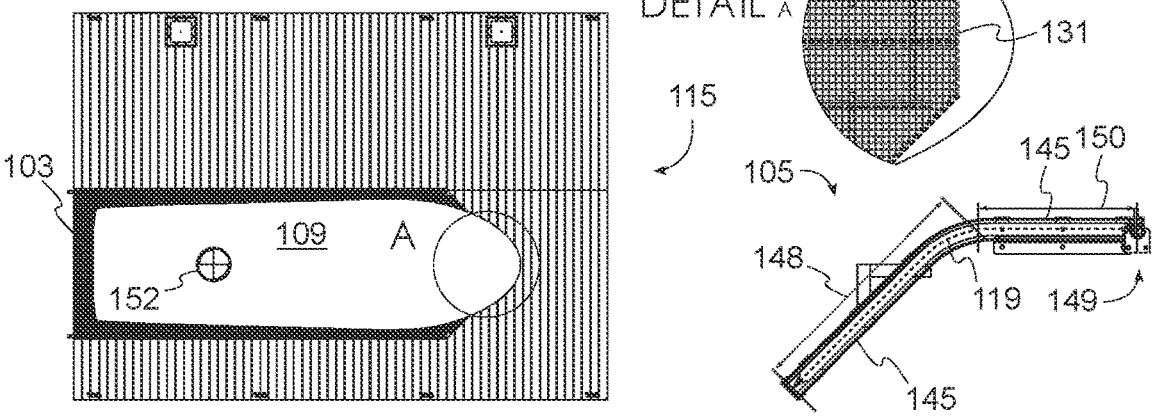

Referring to FIG. 11, in addition to the lifting displacement from the lowered position 111 to the raised position 113, the lift deck assembly 103 may then further be displaced along the horizontal parking portion 147 of the track rails 105 into a parked position 149. This movement may be performed manually by the user, or an additional mechanism may be included in various embodiments. The movement from the lowered position 111 to the raised position 113 is a lifting stroke 148 of the movement path 119, and the movement from the raised position 113 to the parked position 149 is a horizontal stroke 150 of the movement path 119.

It is contemplated herein that the horizontal movement in the track rail 105 provides some benefit. Some vessels that are similar in weight will often vary in length due to configuration differences. In order to allow for longer vessels within the lift's load rating, the lift deck assembly 103 moves away from the parent dock 115 as it descends, allowing for the vessel 109 bow to extend over the forward end of the lift decking 131. When the lift deck assembly 103 and vessel are raised, the part of the vessel 109 which extends forward of the lift decking 131 would physically interfere with the parent dock 115 if it were not for the horizontal portion of forward travel. In this case, the boat fully at the raised position 113 is allowed to roll forward until the vessel 109 bow is protruding over the deck of the parent dock 115 as shown in FIG. 11.

In various embodiments, the track rails 105 may be constructed of any suitable material, such as, but not limited to, stainless steel, galvanized steel, aluminum, or plastic or other non-metallic material which may be used for the track rails 105 if a reinforced area is included beneath the horizontal parking portion 147 for strength. The track rails 105 may be fashioned to adapt to any type of marine dock construction. In situations with no tidal fluctuations and a constant water level, the track rails 105 may alternatively be connected to a fixed pier, concrete abutment, or other fixed structure as appropriate. The track rails 105 may further comprise one or more glide pads 151 made of a material such as, but not limited to, ultra-high molecular weight polyethylene (UHMW), which also has significant toughness, abrasion resistance, and wear resistance properties. The glide pad 151, shown in FIGS. 10A-10D, additionally functions to resist free-play within the track rail 105 and as a parking detent for the forward track pins 135 once they have cleared the glide pad 151 while moving into the parked position 149.

The use of multiple track pins 135 on both lateral sides of the lift deck assembly 103 ensures that the lift decking 131 will remain parallel with the parent decking 133 of the parent dock 115. In a case the center of gravity 152 of a deck load is not perfectly aligned over the center of gravity of the lift tanks 129, the load imbalance will manifest on individual track pins 135 relative to one another but the angle of the lift decking 131 will not be greater than the play between the track pins 135 and track rails 105. Therefore, the lift decking 131 will remain virtually plumb and parallel with the parent dock decking 133.

Figure 12:
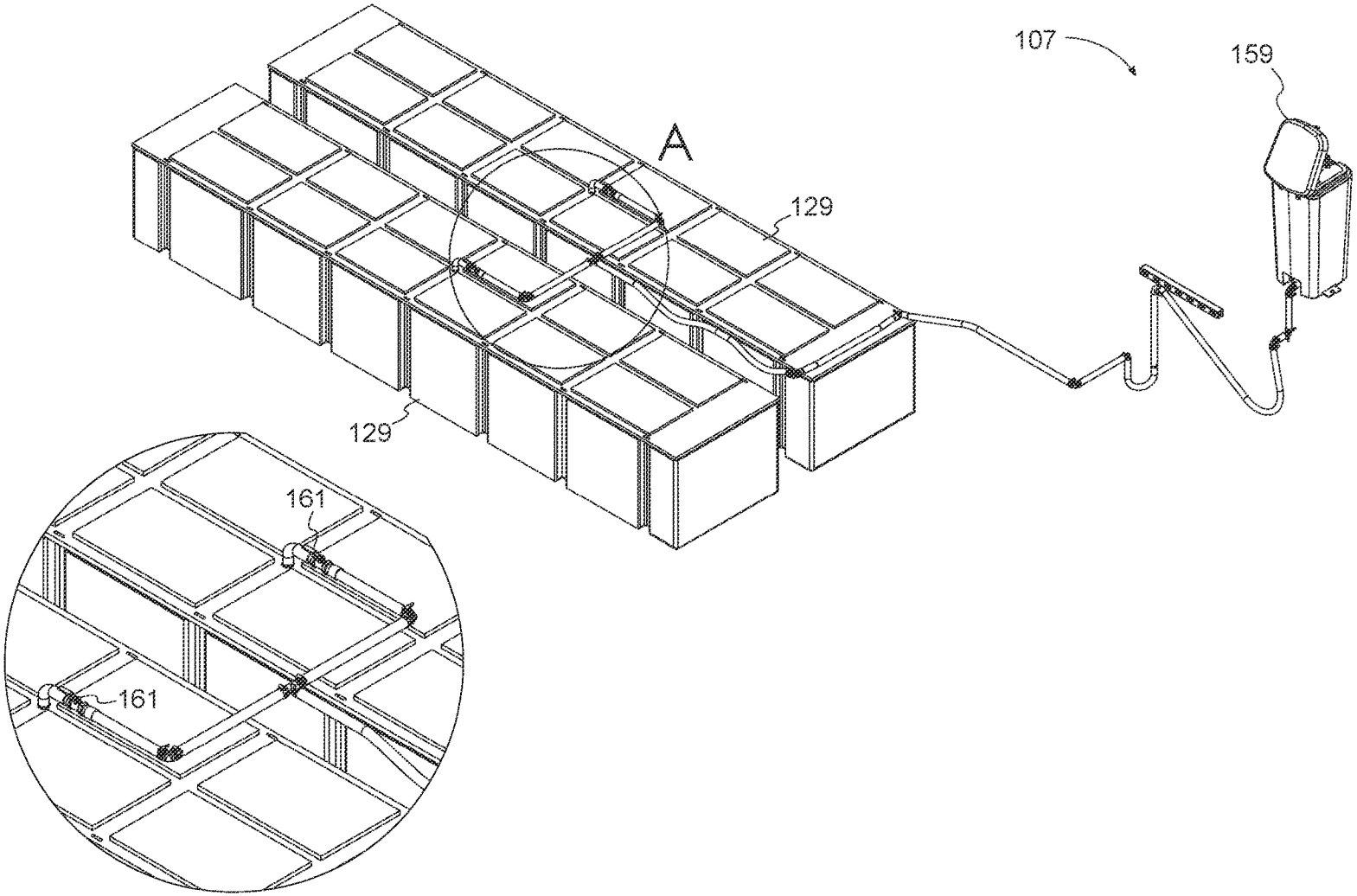
FIG. 12 is an isometric isolation view of the lift control system connected to lift tanks of the lift deck assembly.

In the contemplated embodiment, the lift control system 107 is an air blower system configured to manage the displacement of pressurized air within one of more lift tanks 129 of the lift deck assembly 103. The lift control system 107 causes the lift deck assembly 103 to ascend or descend by controlling the buoyancy of said lift tanks 129. FIG. 12 shows an isolated view of an exemplary air blower system.

Figure 13A:
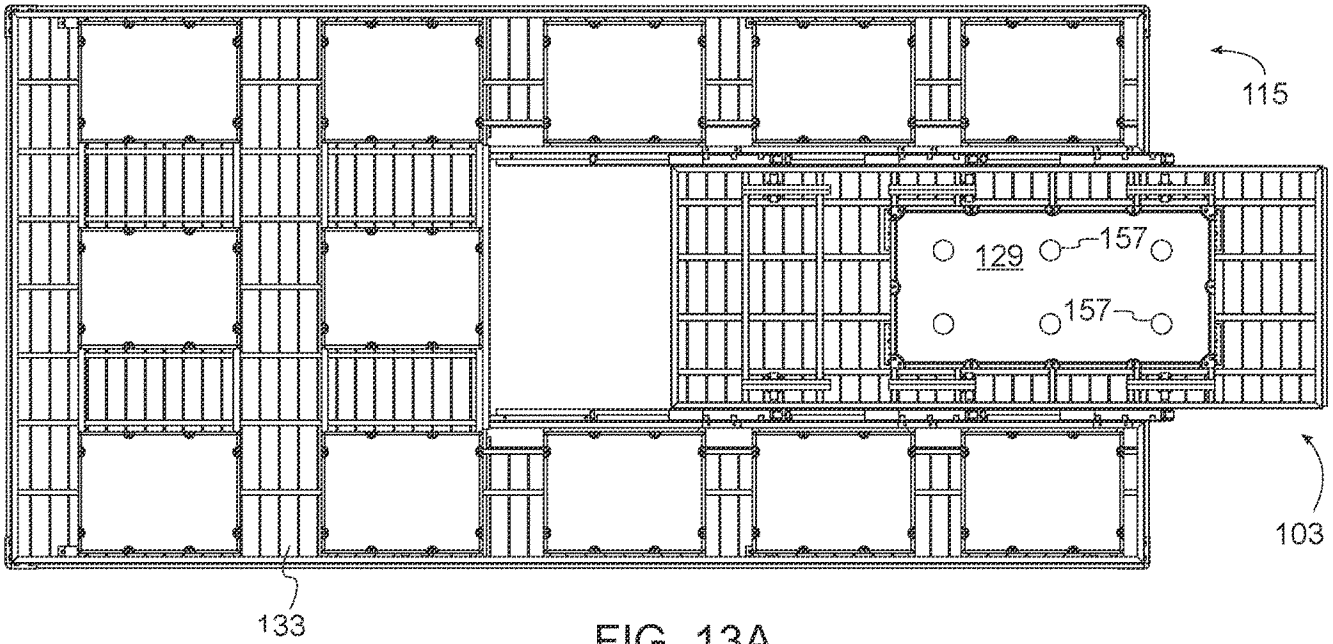
FIG. 13A is a bottom view of the marine rail lift system.
Figure 13B:
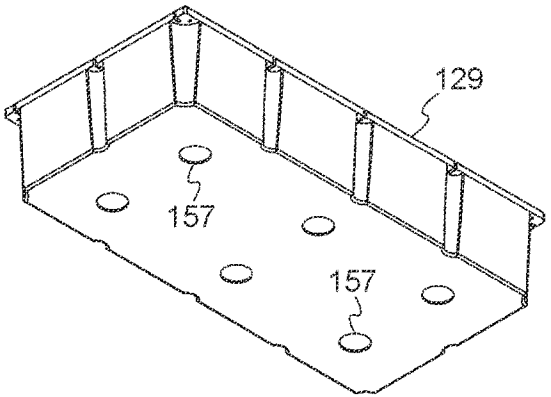
FIG. 13B is a lowered isometric view showing the buoyancy control apertures in the bottom of a lift tank of the lift deck assembly.

In order to do so, in the contemplated embodiment, each of the lift tanks 129 has one or more buoyancy control apertures 157 as shown in FIGS. 13A-13B which allow for bi-directional flow of water into and out of the tank 129. To control the buoyancy of the lift tanks 129, the air blower system controls the amount of air contained therein. When air is forced into the lift tanks 129, water is expelled through the buoyancy control apertures 157, and thus the buoyancy of the lift tanks 129 is increased. Maximum lift is achieved when a sufficient air flow rate is forced into the lift tanks 129 to expel all water, resulting in a maximum amount of air contained therein. Such an air flow rate may be approximately 1 to 3 PSI at 125 to 200 CFM. Maximum lift is achieved when air bubbles are seen breaking the surface of the water surrounding the tank. To completely submerge the lift deck assembly 103, a valve at an air control station 159 is opened to allow air to escape from the lift tanks 129, replaced by water flowing into the lift tanks 129 through the permanently open buoyancy control apertures 157.

In the contemplated embodiment, the lift deck assembly 103 is level with the parent dock 115 when in the raised position 113 and parked position 149, and the lift deck assembly 103 is adjacent to a waterline beneath the parent dock 115 when in the lowered position 111. More particularly, the lift decking 131 is preferably level with a parent decking 133 of the parent dock 115 when in the raised position 113 and parked position 149. Moreover, the lift deck assembly 103 is configured to maintain parallel alignment with the parent dock 115 regardless of load imbalance.

Moreover, the lift deck assembly 103 may include various components and structures which may be understood to be common in the art, such as, but not limited to, the lift tanks 129, the float frame 125, deck support cross-members, bunk support beams, deck joists, track rail pins 135 and pin housings 136, deck support gussets, bunk rails, bunk rail receivers, one or more air lines, valves and fittings, and lift decking 131. The lift decking 131 may be constructed of any suitable material, including, but not limited to, wood, plastic, aluminum, composite planks, plastic and/or fiberglass panels, and the like. It is similarly contemplated and will be appreciated that any of the various components of the present invention may be constructed from any commonly used or otherwise suitable material as may be anticipated by a person skilled in the art.

A case of significant imbalance will prevent the lift deck assembly 103 from being moved along the horizontal parking portions 147 of the track rails 105 into the raised position 113. In this case, it is necessary to reposition the vessel on the deck bunking. Proper positioning of the vessel on the deck bunking is evident when very little effort is required to transition the lift deck assembly 103 fully into the raised position 113. It is contemplated that since little effort should be required to slide the track rail pins along the horizontal parking portion 147 of the track rails 105, the total available flotation exceeds the flotation required to lift at the rated capacity by 15% to 20%. A lift rated at 5,000 lbs is equipped with lift tanks capable of lifting up to 6,000 lbs.

When parking the lift deck assembly 103, a small amount of ballast air is released from the lift tanks 129, causing the lift deck assembly 103 to rest lightly on the track pins 135, stabilizing the deck platform within the parent dock 115. In the raised position 113, the lift decking 131 of the lift deck assembly 103 will be at the same elevation as the parent decking 133 of the parent dock 115, such that the parent dock 115 and the lift deck assembly 103 appear as a seamless unit.

In the contemplated embodiment, as previously mentioned the lift control system 107 incorporates an electric air blower system including any various valves, switches, electronic control components, and other components necessary to implement the present invention according to the spirit and scope herein disclosed. Various parts of the blower system are preferably enclosed within a housing that will provide protection from the elements.

The air blower system is in fluid communication with the lift tanks 129 through an air pathway consisting of one or more of rigid piping, reinforced hose, flexible tubing, or the like or any combination thereof, linked together via suitable connectors such as barbed elbow fittings, hose clamps, and the like. Each lift tank 129 may have its own isolation valve 161 in line with the air pathway at an air input/output port of the lift tank 129. The isolation valve 161 is typically closed when the present invention is to be not used for an extended period of time in order to reduce the possibility of leaks occurring in the air pathway. The isolation valve 161 also allows for maintenance of the air system by holding the lift deck assembly 103 in the raised position 113 when the air pathway is compromised or when removing the air blower assembly for repair or under other relevant circumstances.

Preferably, the lift control system 107 may be controlled wirelessly and remotely through a hand-held transmitter device, or other suitable wireless communication device. However, manual operation capabilities may be further implemented.

Figure 14:
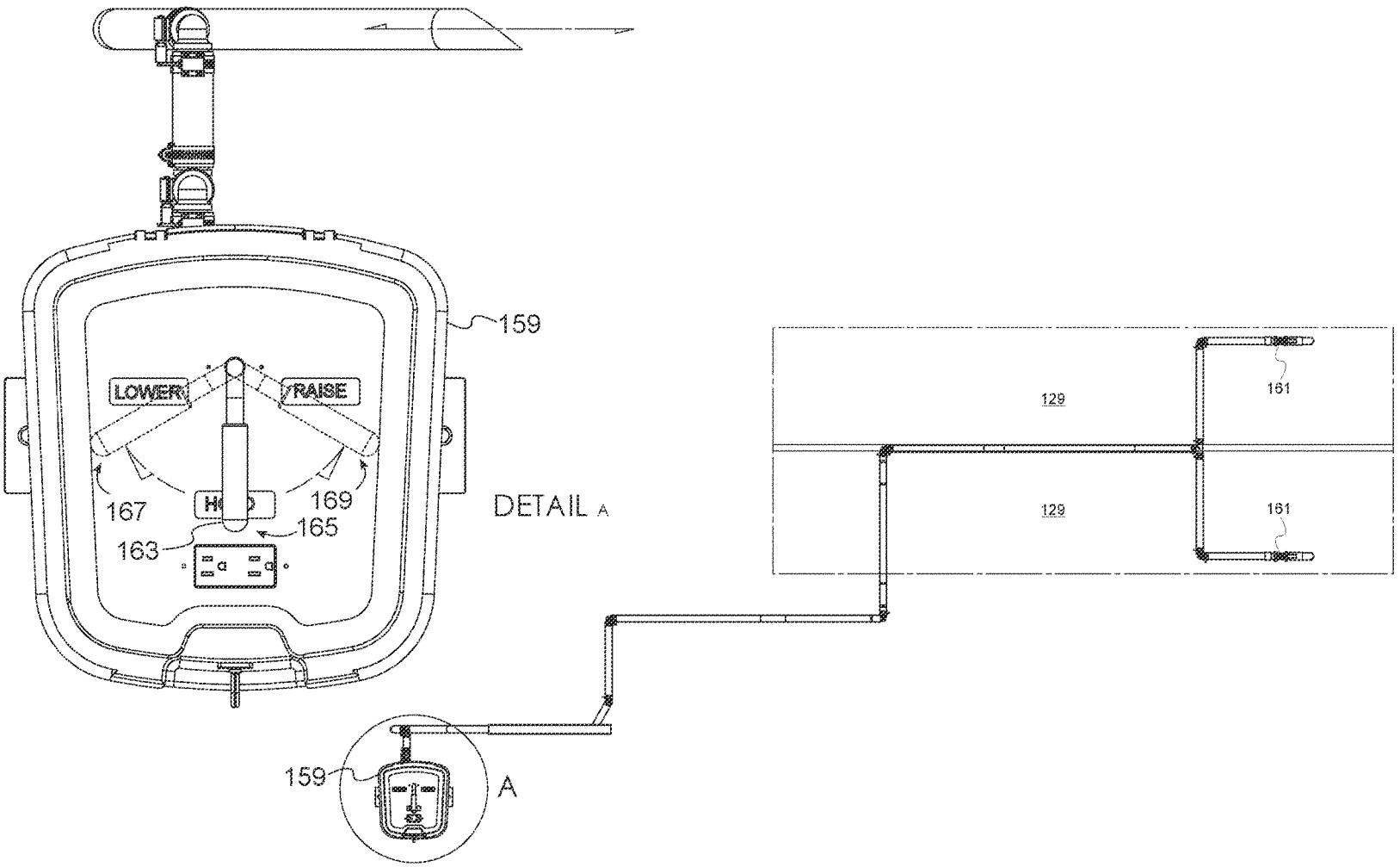
FIG. 14 is a plan isolation view of the lift control system connected to lift tanks of the lift deck assembly with a detail view of an operator station of the lift control system.

To this end, a control station 159 may be provided with one or more user input devices. As seen in FIG. 14, in the contemplated embodiment, a rotating three-position valve actuator 163 is provided as the user input device, through which the user may select a mode of operation by rotating the actuator 163 to one of three positions, such that the control station 159 regulates an air pathway between the air blower and the lift tanks 129 to control the buoyancy thereof. Preferably, the valve actuator 163 manipulates a diverting type ball valve with two open positions and one closed position.

In the closed position 165, air is trapped in the lift tanks 129 of the lift deck assembly 103, maintaining the lift deck assembly 103 in the raised position 113. In a first open position 167, corresponding to lowering the lift deck assembly 103, the air pathway is open such that air trapped within the lift tanks 129 is allowed to vent to atmosphere, reducing the buoyancy of the lift tanks 129. In a second open position 169, corresponding to raising the lift deck assembly 103, the air pathway is again and the air blower system is engaged, forcing air into the lift tanks 129, increasing the buoyancy thereof and causing the lift deck assembly 103 to raise.

Figure 15:
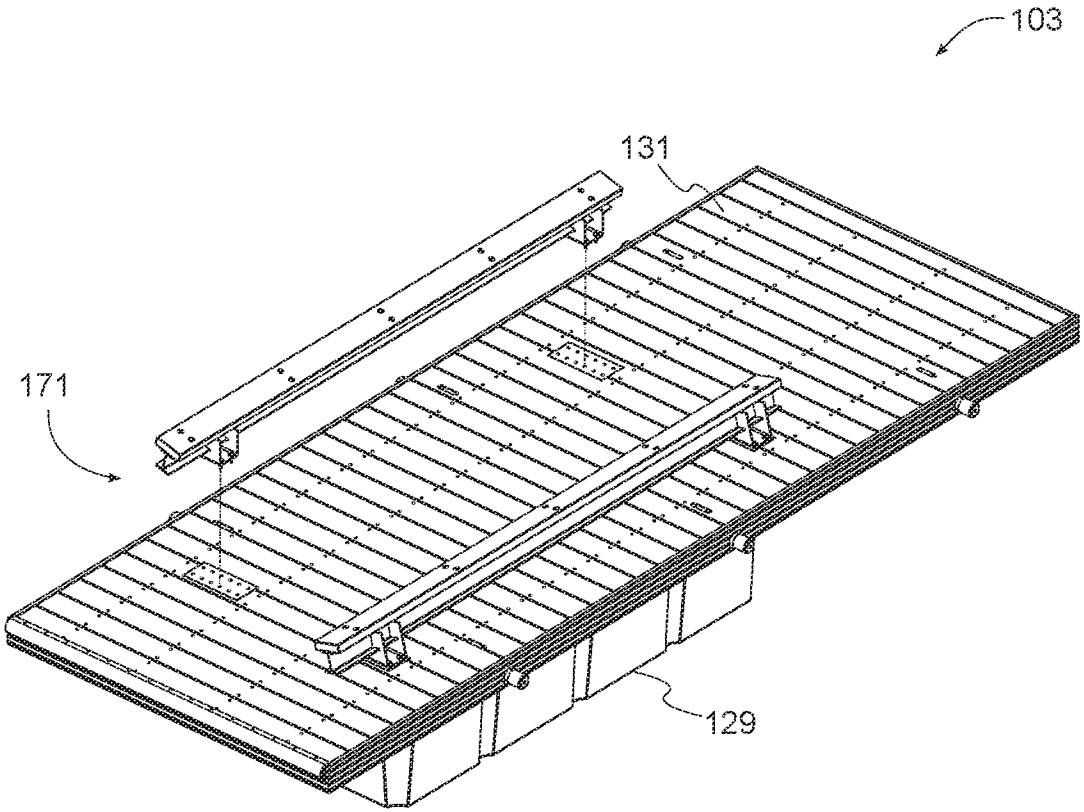
FIG. 15 is an isometric view of the lift deck assembly illustrating a removable bunking system for receiving a watercraft.

The contemplated embodiment further incorporates a bunking system 171 configured to receive the watercraft 109 and align the watercraft 109's center of gravity 152 over the lift deck assembly 103's center of gravity in order to further ensure stability and balanced load distribution on the lift deck assembly 103. When configured as a boat lift, the bunking system 171 is configured to transfer loads due to borne watercraft 109 through the lift decking 131 surface, into the float frame 125 and onto the lift tanks 129. Further, as shown in FIG. 15, the bunking system 171 may be removably attached to the lift deck assembly 103 through various means, enabling removal of the bunking system 171 to use the lift decking 131 as a flat multi-utility deck or for other purposes.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A marine rail lift system comprising:

a lift deck assembly configured to move between a raised position and a lowered position relative to a parent dock along a plurality of track rails;

the track rails being connected within a berth of the parent dock, wherein the track rails define a movement path of the lift deck assembly between the raised position and the lowered position;

a lift control system operatively engaged with the lift deck assembly, configured to displace the lift deck assembly between the raised position and the lowered position, wherein the lift deck assembly is configured to accept one or more watercraft thereupon;

wherein the lift deck assembly is configured to convey the watercraft between the raised position and the lowered position;

wherein the lift deck assembly is level with the parent dock when in the raised position;

wherein the lift deck assembly is adjacent to a waterline beneath the parent dock when in the lowered position; and wherein lift deck assembly further comprises a plurality of retractable track pins configured to lock into the track rails.

2. The marine rail lift system of claim 1, wherein the track rails are connected in pairs to opposing side walls of the berth.

3. The marine rail lift system of claim 1, wherein the plurality of track rails comprises a plurality of pairs of track rails evenly distributed along a side wall of the berth.

4. The marine rail lift system of claim 1, wherein each of the plurality of track rails comprises an angled lift portion and a horizontal parking portion.

5. The marine rail lift system of claim 1, wherein a first end of the track rails corresponds to the lowered position, and wherein a second end of the track rails corresponds to the raised position.

6. The marine rail lift system of claim 1, wherein the lift control system is configured to manage a displacement of pressurized air within one or more lift tanks of the lift deck assembly.

7. The marine rail lift system of claim 1, wherein the lift control system includes manual and remote operation capabilities.

8. The marine rail lift system of claim 1, wherein the parent dock comprises a header dock portion and a pair of finger dock portions affixed to the header dock portion, wherein each of the track rails is connected to one of the finger dock portions, wherein the parent dock forms a horseshoe dock configuration around the berth.

9. The marine rail lift system of claim 1, wherein a lift decking of the lift deck assembly is level with a parent decking of the parent dock when in the raised position.

10. The marine rail lift system of claim 1, wherein the lift deck assembly is configured to maintain parallel alignment with the parent dock regardless of load imbalance.

11. The marine rail lift system of claim 1, wherein the lift deck assembly further comprises a bunking system configured to receive the watercraft and position the watercraft's center of gravity over the lift deck assembly's center of gravity.

* * * * *